US009885261B2

(12) United States Patent
Hoglund

(10) Patent No.: US 9,885,261 B2
(45) Date of Patent: Feb. 6, 2018

(54) ACTUATOR FOR AXIAL DISPLACEMENT OF AN OBJECT

(71) Applicant: FREEVALVE AB, Angelholm (SE)

(72) Inventor: Anders Hoglund, Munka Ljungby (SE)

(73) Assignee: FREEVALVE AB, Angelholm (SE)

( * ) Notice: Subject to any disclaimer, the term of this patent is extended or adjusted under 35 U.S.C. 154(b) by 259 days.

(21) Appl. No.: 14/903,878

(22) PCT Filed: Jul. 7, 2014

(86) PCT No.: PCT/SE2014/050864
§ 371 (c)(1),
(2) Date: Jan. 8, 2016

(87) PCT Pub. No.: WO2015/005856
PCT Pub. Date: Jan. 15, 2015

(65) Prior Publication Data

US 2016/0369666 A1 Dec. 22, 2016

(30) Foreign Application Priority Data

Jul. 8, 2013 (SE) ..... 1350849

(51) Int. Cl.
*F15B 11/08* (2006.01)
*F01L 9/02* (2006.01)
(Continued)

(52) U.S. Cl.
CPC ..... *F01L 9/021* (2013.01); *F01L 13/0036* (2013.01); *F15B 11/10* (2013.01); *F15B 13/044* (2013.01); *F15B 13/0435* (2013.01)

(58) Field of Classification Search
CPC .. F15B 13/044; F15B 13/043; F15B 13/0435; F15B 11/10; F01L 9/021
(Continued)

(56) References Cited

U.S. PATENT DOCUMENTS 5,193,495 A 3/1993 Wood, III
6,039,077 A * 3/2000 Schulze ..... F15B 9/10 137/625.63
(Continued)

FOREIGN PATENT DOCUMENTS

EP 1 491 731 A1 12/2004
EP 1 491 733 A1 12/2004
(Continued)

OTHER PUBLICATIONS

Supplementary European Search Report issued in Application No. 14822299.5, dated Mar. 10, 2017.
(Continued)

*Primary Examiner* — F. Daniel Lopez
*Assistant Examiner* — Daniel Collins
(74) *Attorney, Agent, or Firm* — Young & Thompson

(57) ABSTRACT

Disclosed is an actuator for axial displacement of an object, including an actuator piston disc displaceable in a cylinder volume, an inlet channel, a first inlet valve body arranged in the inlet channel, a second inlet valve body operatively connected to the actuator piston disc and arranged in the inlet channel, an outlet channel and an outlet valve body arranged therein. The actuator includes an electrically controlled pilot valve communicating a first control pressure to the first inlet valve body via a first control pressure channel and communicating a second control pressure to the outlet valve body via a second control pressure channel. The pilot valve places itself in either a resting state or an active state.

20 Claims, 13 Drawing Sheets

(51) Int. Cl.

| | |
|---|---|
| ***F01L 13/00*** | (2006.01) |
| ***F15B 11/10*** | (2006.01) |
| *F15B 13/043* | (2006.01) |
| *F15B 13/044* | (2006.01) |

(58) Field of Classification Search
USPC ..... 91/461, 454
See application file for complete search history.

(56) References Cited

U.S. PATENT DOCUMENTS

| | | | |
|---|---|---|---|
| 6,082,243 | A | 7/2000 | Schmucker et al. |
| 2012/0018010 | A1 | 1/2012 | Gaumnitz et al. |

FOREIGN PATENT DOCUMENTS

| | | | |
|---|---|---|---|
| WO | 2010/054653 | A1 | 5/2010 |
| WO | 2013/058704 | A1 | 4/2013 |

OTHER PUBLICATIONS

International Search Report, dated Nov. 4, 2014, from corresponding PCT Application.

* cited by examiner

ACTUATOR FOR AXIAL DISPLACEMENT OF AN OBJECT

TECHNICAL FIELD OF THE INVENTION

The present invention relates to an actuator for axial displacement of an object. The present invention is particularly useful in applications having demands on high velocities/speeds and exact control of the axial displacementability, and also demands on low operation noise. In particular, the present invention relates to a gas exchange valve actuator for internal combustion engines, where the actuator is suggested to be used for driving one or more inlet valves or outlet valves controlling the supply or evacuation, respectively, of air relative to the cylinders of the internal combustion engine. The actuator according to the invention is thus especially suitable for driving engine valves and thereby eliminates the necessity for one or more camshafts in an internal combustion engine.

The actuator according to the invention comprises an actuator piston disc and a cylinder volume, wherein the actuator piston disc separates said cylinder volume in a first portion and a second portion and is in axial direction displaceable back and forth in said cylinder volume between an inactive position and an active position, and further comprises an inlet channel extending between a pressure fluid inlet and the first portion of the cylinder volume, a first inlet valve body and a second inlet valve body arranged in said inlet channel, an outlet channel extending between the first portion of the cylinder volume and a pressure fluid outlet, and an outlet valve body arranged in said outlet channel.

BACKGROUND OF THE INVENTION AND PRIOR ART

Thus, an actuator, commonly known as a pneumatic actuator, comprises an actuator piston disc that is displaceable in axial direction between a first position (inactive position) and a second position (active/extended position). The displacement is achieved by controlling a supply of pressure fluid, such as pressurized gas/air, that acts on the actuator piston disc. The actuator piston disc in turn directly or indirectly acts on the object that is to be displaced, for example an engine valve, for controlling its position.

When the actuator piston disc is in the inactive position the engine valve is in contact with its seat, and when the actuator piston disc is in the active position the engine valve is open, i.e. situated at a distance from its seat.

In the applicants own document WO 2013-058704 an actuator is described in which a pressure pulse, which is started by a first inlet valve body opening and allowing pressure fluid from a pressure fluid source to act on and drive the actuator piston disc from its resting position, is stopped by a second inlet valve body, that is rigidly connected to and jointly displaceable with the actuator piston disc, cutting the flow from the pressure fluid source and thereby closes the inlet channel. This construction provides a direct correlation between the pulse length and the travel that the actuator piston disc performs.

Nevertheless, the valve bodies that open/close the inlet channel and the outlet channel have in this publication relatively large mass and small throughput areas. It is also known that some applications demand high working pressure/high pressure, for example 20-25 Bar, to achieve a correct function of the actuator, i.e. to unction together with internal combustion engines with a range of number of turns up to 8-10 thousand turns per minute. There is further a wish to avoid that the temperature rises in the actuator and the surrounding parts/fluids in such applications as a result of the very operation of the actuator and the accompanying compressor, and this is achieved by holding a pressure relation low and thereby a so called enhanced return pressure is used, also known as low pressure/base pressure. In other words the pressure of the pressure fluid that is located downstream from the actuator and upstream from the compressor is much higher than the atmospheric pressure, for example 4-6 Bar. The relatively large mass of the valve bodies results in that the valve bodies risk to rebound from their seats when they shall place themselves in their respective resting positions, whereby jarring and vibrations arise and/or the included parts are damaged, and lead to imprecise control of the pressure fluid in the inlet channel and the outlet channel, respectively.

The relatively small throughput areas in combination with the high return pressure lead to, at the return of the actuator to the inactive position, the evacuation of the pressure fluid from the cylinders first portion risks to be insufficient, which leads to a slow return of the actuator piston disc.

OBJECT OF THE INVENTION

The present invention aims at obviating the abovementioned drawbacks and shortcomings of earlier known actuators and to provide an improved actuator. A basic object of the invention is to provide an improved actuator of the initially defined type that eliminates the emergence of the jarring from the actuator.

A further object of the present invention is to provide an actuator that can have a high return pressure and at the same time have a lower ratio between working pressure and return pressure.

It is another object of the present invention to provide an actuator showing greater throughput areas of the actuators first inlet valve, second inlet valve, and outlet valve, respectively.

It is another object of the present invention to provide an actuator with direct correlation between the pulse length and the movement that the actuator piston disc performs.

BRIEF DESCRIPTION OF THE INVENTION

According to the invention at least the basic object is achieved by way of initially defined actuator, which has the features defined in the independent claims. Preferred embodiments of the present invention are further defined in the dependent claims.

According to a first aspect of the present invention an actuator of the initially defined type is provided, which is characterized in that it comprises an electrically controlled pilot valve arranged to communicate a first control pressure to the first inlet valve body via a first control pressure channel and arranged to communicate a second control pressure to the outlet valve body via a second control pressure channel. The pilot valve is arranged to place itself in an inactive state, in which the first control pressure channel is in fluid communication with a control fluid inlet of the pilot valve and the second control pressure channel is in fluid communication with a control fluid outlet of the pilot valve, and in an active state, in which the first control pressure channel is in fluid communication with the control fluid outlet and the second control pressure channel is in fluid communication with the control fluid inlet, respectively, and that the inlet channel is kept closed by the second inlet valve body when the actuator piston disc is located at least a predetermined distance from its inactive position.

Accordingly, the present invention is based on the insight that by having separate valve bodies to open and close the inlet channel and the outlet channel, respectively, can the weight of each valve body be reduced, and that the high control pressure from the pilot valve always is used to alternatingly close the first inlet valve body and outlet valve body, respectively.

According to a preferred embodiment of the present invention, the actuator comprises a hydraulic circuit, which comprises a locking volume, a non return valve, and a hydraulic valve, wherein the actuator piston rod is arranged to be displaced in axial direction relative to said locking volume in connection with axial displacement of the actuator piston disc in the cylinder volume. This results in that the actuator piston disc can be held in its active position/lower dead centre a predetermined or adjusted time.

Further advantages of and features of the invention are evident from the other dependent claims and from the following detailed description of preferred embodiments.

BRIEF DESCRIPTION OF THE DRAWINGS

A more complete understanding of the abovementioned and other features and advantages of the present invention will be evident from the following detailed description of preferred embodiments with reference to the enclosed drawings, in which.

DETAILED DESCRIPTION OF PREFERRED EMBODIMENTS

Figure 1:
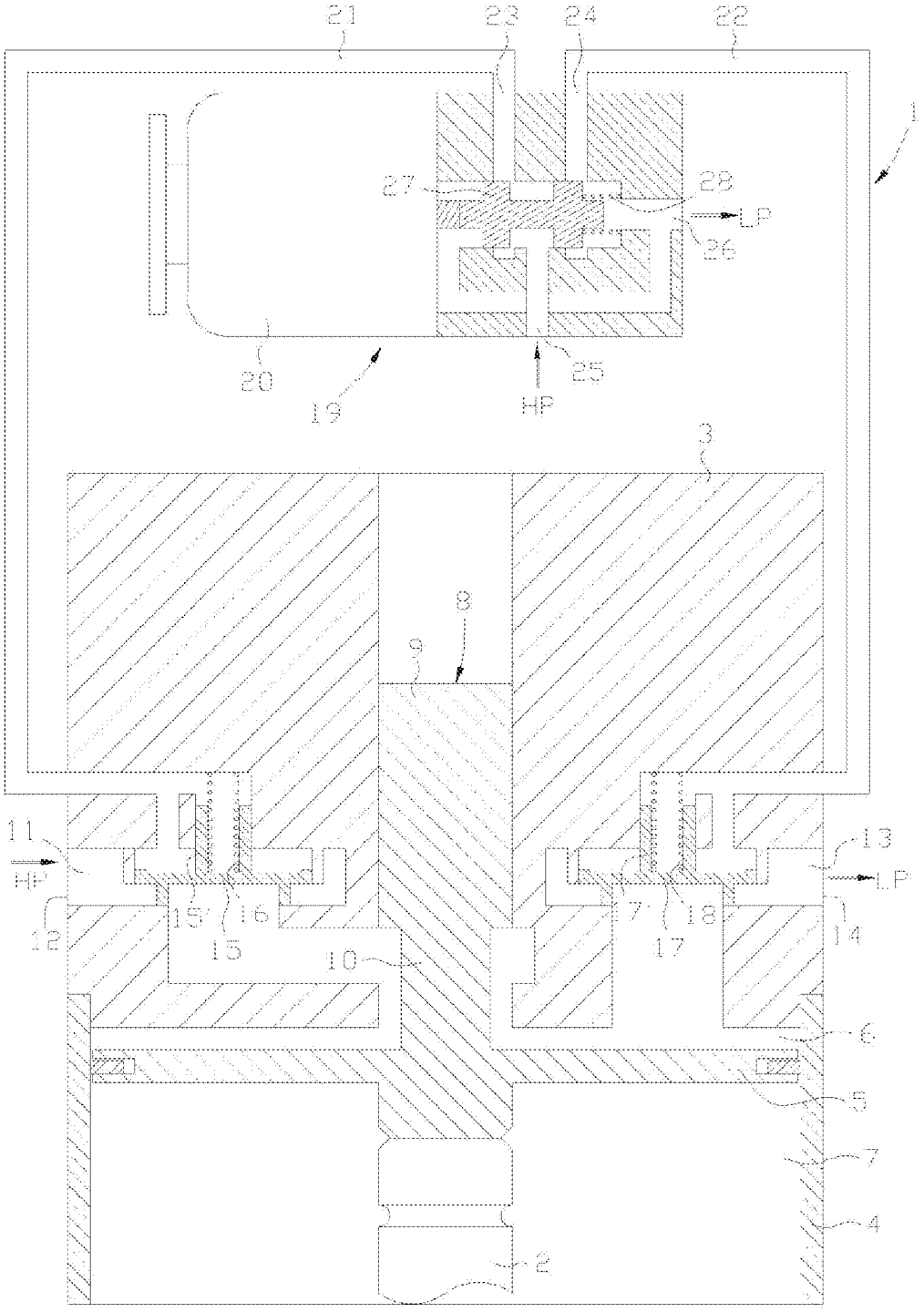
FIG. 1 is a schematic cross sectional view from the side of an actuator according to a first embodiment of the invention, where the actuator is in its inactive state.
Figure 2:
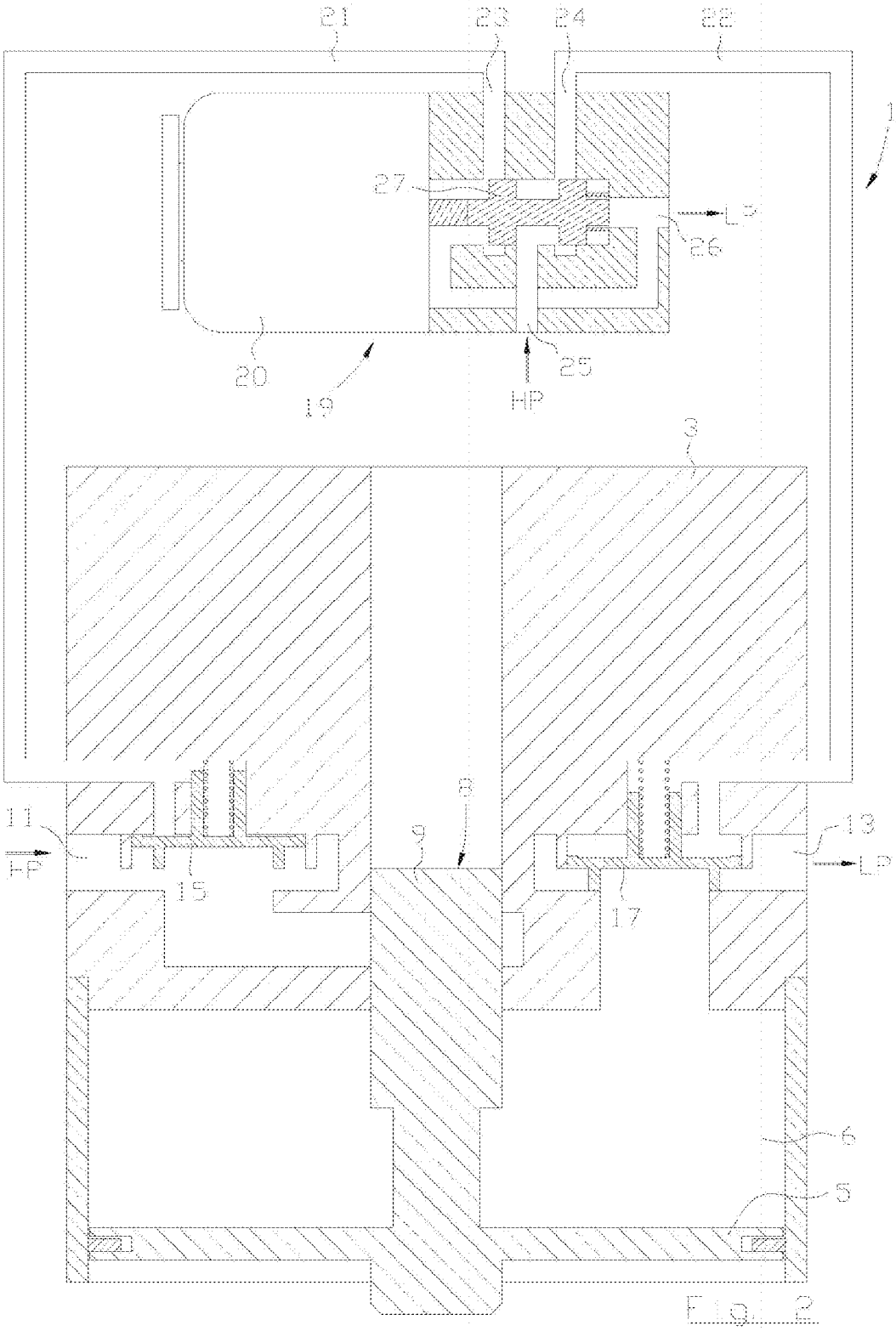
FIG. 2 is a schematic cross sectional view from the side corresponding to FIG. 1, where the actuator piston disc is in its lower dead centre.

Reference is initially made to the FIGS. 1 and 2. The present invention relates to an actuator, generally denoted 1, for axial displacement of an object, such as an actuator 1 for axial displacement of a gas exchange valve 2 of an internal combustion engine. Herein below the invention will be described in an exemplifying but not to a limiting end with reference to an application in which the actuator 1 is used for driving one or more inlet valves or outlet valves 2 in an internal combustion engine.

In the shown embodiment, the actuator 1 comprises an actuator housing 3, a cylinder 4 delimiting a cylinder volume or chamber, an actuator piston disc 5 that is arranged in and that in axial direction is displaceable back and forth in said cylinder volume between an inactive resting position (FIG. 1) and an active position/lower dead centre (FIG. 2). The actuator piston disc 5 separates said cylinder volume in a first upper portion 6 and a second lower portion 7. The valve shaft of the gas exchange valve 2 ends in the second portion 7 of the cylinder volume, and the gas exchange valve 2 is biased in a direction upward by means of a conventional valve spring or gas spring (not shown). The actuator piston disc 5 returns to its inactive position by being biased, preferably by way of spring means, in a direction upward. The spring means may be a mechanical spring or gas spring situated in in the second portion 7 of the cylinder volume. In the event the actuator piston is connected to and drives an inlet or outlet valve to an internal combustion engine the spring may be composed of a valve spring that lifts the gas exchange valve to its closed position. However, alternative solutions to realize the biasing are conceivable within the framework of the present invention.

The actuator 1 further comprises an actuator piston rod, generally denoted 8, which is rigidly connected to and axially extending from the actuator piston disc 5, and which together with the actuator piston disc forms an actuator piston. The actuator piston rod 8 eliminates the risk for a skew setting of the actuator piston disc 5. The actuator piston rod 8 has in the shown embodiment a first thicker portion 9, which is situated at a distance from the actuator piston disc 5 and is in a tight fit with a channel in the actuator housing 3, and a second thinner portion 10 extending between and connecting the thicker portion 9 and the actuator piston disc 5. In this embodiment, the thicker portion constitutes a second inlet valve body that will be described herein below.

The actuator 1 also comprises a pressure fluid circuit, preferably a pneumatic, configured for a controllable supply of a gas or gas mixture, for example air, to the first portion 6 of the cylinder volume to generate a displacement of the actuator piston disc 5, and configured for controllable evacuation of the gas or gas mixture from the first portion 6 of the cylinder volume to generate a return movement of the actuator piston disc 5.

The pressure fluid circuit comprises an inlet channel 11 extending between a pressure fluid inlet 12 in the actuator housing 3 and the first portion of the cylinder volume, and an outlet channel 13 extending between the first portion 6 of the cylinder volume and a pressure fluid outlet 14 in the actuator housing 3. Said inlet channel 11 is via the pressure fluid inlet 12 connected to a pressure fluid source (HP), and said outlet channel 13 is via the pressure fluid outlet 14 connected to a pressure fluid sink (LP). In other words the pressure fluid inlet 12 of the actuator 1 is configured to be connected to the pressure fluid source (HP), and the pressure fluid outlet 14 is configured to be connected to the pressure fluid sink (LP). The pressure fluid source may be a compressor that belongs to the engine and with or without a belonging tank, or only a pressure tank. The pressure fluid sink may be any point with a lower pressure than the one generated in the pressure fluid source, for example a conduit leading back to the compressor. The pressure fluid circuit is preferably a closed system with a raised return pressure, i.e. the pressure fluid sink (LP) has for example a pressure of 4-6 Bar, and the pressure fluid source has for example a pressure of 15-25 Bar.

The actuator 1 comprises a first inlet valve body 15 arranged in said inlet channel 11 for controlling the flow of pressure fluid in the inlet channel 11 past the position where the first inlet valve body 15 is situated, i.e. arranged to open and close, respectively, the inlet channel 11. The first inlet valve body 15 is preferably a seat valve, and it is preferably biased by way of a spring 16 in one the inlet channel 11 closing direction. The first inlet valve body 15 preferably comprises a control rod 15' for eliminating the risk of a skew setting thereof. The first inlet valve body preferably has an axial placement against the surrounding actuator housing 3 in its both end positions, i.e. fully open and fully closed, for achieving a good sealing without leakage.

The actuator 1 comprises an outlet valve body 17 arranged in said outlet channel 13 for controlling the flow of pressure fluid in the outlet channel 13 past the position where the outlet valve body 17 is situated, i.e. arranged to open and close, respectively, the outlet channel 13. The outlet valve 17 is preferably a seat valve, and it is preferably biased by way of a spring 18 in one the outlet channel 13 closing direction. The outlet valve body 17 preferably comprises a control rod 17' for eliminating the risk of a skew setting thereof. Preferably, the outlet valve body 17 has an axial placement against the surrounding actuator housing 3 in its both end positions, i.e. fully open and fully closed, for achieving a good sealing without leakage.

The actuator 1 also comprises a second inlet valve body that in the shown embodiment is constituted by the thicker portion 9 of the actuator piston rod 8 and that is arranged in said inlet channel 11, i.e. arranged to open and close, respectively, the inlet channel 11. The other inlet valve body is configured to hold the inlet channel 11 closed when the actuator piston disc 5 is located at least a predetermined distance from its inactive position.

According to the shown embodiment, the first inlet valve body 15 and the second inlet valve body 9 are arranged in series with each other, and preferably the second inlet valve body 9 is arranged between the first inlet valve body 15 and the first portion 6 of the cylinder volume, since the first inlet valve body 15 provides a better sealing than the second inlet valve body 9.

It is essential for the actuator that it comprises an electrically controlled pilot valve, generally denoted 19, that is configured to control the first inlet valve body 15 and the outlet valve body 17. By electrically controlled means controlled by way of an electro magnetic device, such as a solenoid 20, by way of a piezo electric device, etc. In all the drawings the pilot valve 19 is drawn situated outside the actuator housing 3, which is fully conceivable, still it is preferable that the pilot valve 19, the first control pressure channel 21 and the second control pressure channel 22, are all situated fully or partly within the actuator housing 3.

In the shown embodiment the actuator 1 comprises a first control pressure channel 21 and a second control pressure channel 22, whereby the first control pressure channel 21 extends between a first outlet 23 of the pilot valve 19 and a space of the actuator housing 3 that is partly delimited by an upper side of the first inlet valve body 15, and whereby the second control pressure channel 22 extends between a second outlet 24 of the pilot valve 19 and a space of the actuator piston housing that is partly delimited of an upper side of the outlet valve body 17. Accordingly, the pilot valve 19 is arranged to communicate a first control pressure to the first inlet valve body 15 via the first control pressure channel 21 and arranged to communicate a second control pressure to the outlet valve body 17 via the second control pressure channel 22.

The pilot valve 19 comprises a control fluid inlet 25 that is configured to be connected to the pressure fluid source (HP), and a pressure fluid outlet 26 that is configured to be connected to the pressure fluid sink (LP). The pilot valve 19 is configured to place itself in a inactive state (inactivated solenoid) in which the first control pressure channel 21 is in fluid communication with the control fluid inlet 25 of the pilot valve 19 and the second control pressure channel 22 is in fluid communication with the control fluid outlet 26 of the pilot valve 19, and an active state (activated solenoid) in which the first control pressure channel 21 is in fluid communication with the control fluid outlet 26 and the second control pressure channel 22 is in fluid communication with the control fluid inlet 25, respectively.

The pilot valve 19 comprises preferably a pilot valve body 29, which is displaceable back and forth between a resting position and an active position, whereby the pilot valve body 27 is biased by way of a spring 28 in a direction toward its resting position. In the shown embodiment the pilot valve body 27 is composed of a sliding valve, however other types of pilot valve bodies are conceivable. Accordingly, the solenoid 20 is configured to displace the pilot valve body 27 in a direction toward its active position when said solenoid 20 is activated.

From the description above it follows that the first control pressure acts on the upper side of the first inlet valve body 15 and the fluid pressure that is present in the inlet channel 11, i.e. the same as in the pressure fluid source (HP), acts on an outer portion of the lower side of the first inlet valve body 15. When the first control pressure is high the first inlet valve body 15 closes the inlet channel 11, and when the first control pressure is low the first inlet valve body 15 opens the inlet channel 11.

Furthermore, the second control pressure acts on the upper side of the outlet valve body 17 and the fluid pressure that is present in the first portion 6 of the cylinder volume acts on an inner part of the lower side of the outlet valve body 17. When the second control pressure is high the outlet valve body 17 closes the outlet channel 13 as a result of the pressurized area on the upper side being greater than the inner pressurized area on the under side, and when the second control pressure is low the outlet valve body 17 is arranged to open the outlet channel 13.

The function of the actuator 1 according to the first embodiment, as shown in the FIGS. 1 and 2, will now be described.

The actuator 1 in its inactive state is shown in FIG. 1, i.e. the pilot valve 19 is in its resting state and the solenoid 20 is inactivated. Then, a high fluid pressure acts in the first control pressure channel 21 and a low fluid pressure acts in the second control pressure channel 22. This results in the actuator piston disc 5 being in inactive position/upper dead centre, and the first inlet valve body 15 being in closed position, the second inlet valve body 9 being in open position as a result of the actuator piston disc 5 being in inactive position, and the outlet valve body 17 being in closed position as a result of it being biased in one the outlet channel 13 closing direction.

When signal is given, for example, from a control unit that the actuator 1 shall perform a displacement of the object/engine valve, the solenoid 20 is activated and the pilot valve 19 change to its active state. This leads to a low fluid pressure acting in the first control pressure channel 21 and high fluid pressure acting in the second control pressure channel 22. The first inlet valve body 15 is opened by the pressure from the pressure fluid source (HP) that acts at the pressure fluid inlet 12. Pressure fluid flows into the first portion 6 of the cylinder volume via the inlet channel 11 and acts on the upper side of the actuator piston disc 5 and displaces the actuator piston in a direction downward. The outlet valve body 17 is kept closed. When the actuator piston disc 5 has been displaced a predetermined distance the second inlet valve 9 cuts off the pressure fluid flow in the inlet channel 11, i.e. prevents a continued supply of pressure fluid from the pressure fluid source (HP) to the first portion 6 of the cylinder volume, whereby the actuator piston disc 5 continues its displacement and positions itself in its active position/lower dead centre, as is shown in FIG. 2. The actuator piston disc 5 continues its displacement downward after the second inlet valve 9 has cut off the inflow to the first portion 6 of the cylinder volume as a result of the gas in the first portion 6 of the cylinder volume expanding and compressing the valve spring of the engine valve. Since it is known how large the pressure is in the pressure fluid source (HP), how great the volume of the first portion 6 of the cylinder volume is when the second inlet valve body 9 cuts the inflow, the valve springs force characteristics, etc. the length of the continued displacement of the actuator piston disc 5 can be controlled with sufficient precision.

Thereafter the solenoid 20 is inactivated, i.e. the pilot valve 19 again reaches its resting state. High fluid pressure again acts in the first control pressure channel 21 and low fluid pressure again acts in the second control pressure channel 22 for allowing a return movement of the actuator piston disc 5. The first inlet valve body 15 closes the inlet channel 11, the outlet valve body 17 is opened by the pressure acting on the first portion 6 of the cylinder volume, and the actuator piston disc 5 is displaced upward by, for example, the valve spring, whereupon the pressure fluid in the first portion 6 of the cylinder volume is evacuated through the outlet channel 13. When the pressure in the first portion 6 of the cylinder volume has declined the outlet valve body 17 is closed by the biasing spring 18. Thereby the actuator 1 is back in the inactive position that is shown in FIG. 1. The actuator piston disc 5 returns to its inactive position in a direction upward by way of a biasing spring means. The spring means may be a mechanical spring or a gas spring located in the second portion 7 of the cylinder volume. In the event the actuator is connected to and drive an inlet or outlet valve of an internal combustion engine the spring may be composed of a valve spring lifting the gas exchange valve to its closed position. Alternative solutions how to realize the biasing are possible and within the framework of the present invention.

References are now made to the FIGS. 3-8 showing a second embodiment of the actuator 1 according to the invention. Only differences in relation to the first embodiment will be described.

In the shown embodiment the actuator 1 also comprises a first hydraulic circuit comprising a locking volume 29, wherein the actuator piston rod 8 is arranged to be displaced in an axial direction relative to said locking volume 29 in connection with axial displacement of the actuator piston disc 5 in the cylinder volume. Liquid (oil) is allowed to flow into the liquid filled locking volume 29 via a non return valve 30 an out from the locking volume 29 via a hydraulic valve 32. The Hydraulic valve 32 comprises a hydraulic valve body 33, which is displaceable back and forth between an inactive position and an active position, wherein the hydraulic valve body 33 is biased by means of a spring 34 in a direction away from its inactive position. Accordingly, the hydraulic valve body 33 is not dependent on the function of the spring 34 for placing itself in the inactive position.

The pilot valve 19 is configured to communicate said first control pressure to the hydraulic valve body 33, wherein the hydraulic valve 32 is open when the pilot valve 19 is in its resting state, and wherein the hydraulic valve 32 is closed when the pilot valve is in its active state. In other words, when the actuator piston is displaced from the inactive position (FIG. 3) to the active position (FIG. 6) the actuator piston rod 8 leaves space for inflow of liquid into the locking volume 29 and the hydraulic valve 32 is closed, and when the actuator rod is displaced from the active position to the inactive position the hydraulic valve 32 must first be opened wherein the liquid is pressed out from the locking volume 29.

In an alternative embodiment of the hydraulic valve is the hydraulic body is biased by a spring in the direction toward its resting position, and in this embodiment the pilot valve 19 is configured to communicate said second control pressure to the hydraulic valve body, wherein the hydraulic valve 32 is open when the pilot valve 19 is in its resting state, and wherein the hydraulic valve 32 is closed when the pilot valve 19 is in its active state.

Further, in the shown embodiment of the actuator 1 according to the invention according to the FIGS. 3-8, the actuator piston rod 8 shows in the region of its free end a hydraulic breaking device, which is configured to reduce the speed of movement of the actuator rod before the actuator piston rod 8 stops, and is thereby configured to reduce the he speed of movement of the engine valve 2 before the engine valve 2 engage its seat. The hydraulic breaking device is composed of a geometric constriction between the actuator piston rod 8 and the locking volume 29, which geometric constriction reduces as the free end of the actuator piston rod 8 approaches its stop position, whereby the speed decreases.

The functions of the actuator 1 according to the second aspect, shown in FIGS. 3-8, will now be described.

Figure 3:
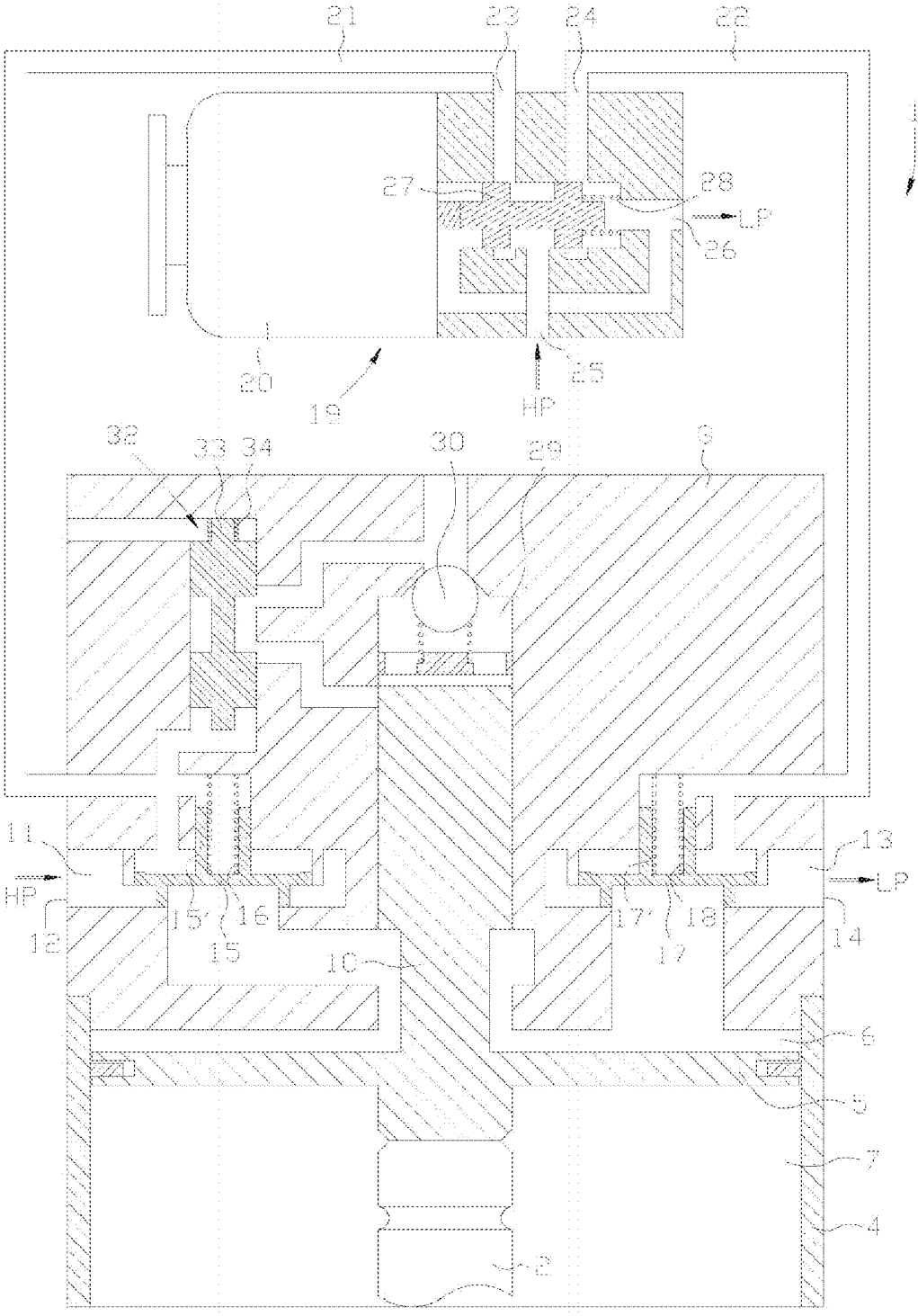
FIG. 3 is a schematic cross sectional view from the side of an actuator according to a second embodiment of the invention, where the actuator is in its inactive state.

In FIG. 3 the actuator 1 is shown in its inactive state, i.e. the pilot valve 19 is in resting state and the solenoid 20 is inactivated. A high fluid pressure then has effect in the first control pressure channel 21 and low fluid pressure has effect in the second control pressure channel 22. The first inlet valve body 15 is in closed position, the actuator piston disc 5 is in resting position/upper dead centre and the second inlet valve body is in open position, the outlet valve body 17 is in closed position because of it being spring biased in one the outlet channel 13 closing direction, and the hydraulic valve 32 is open.

Figure 4:
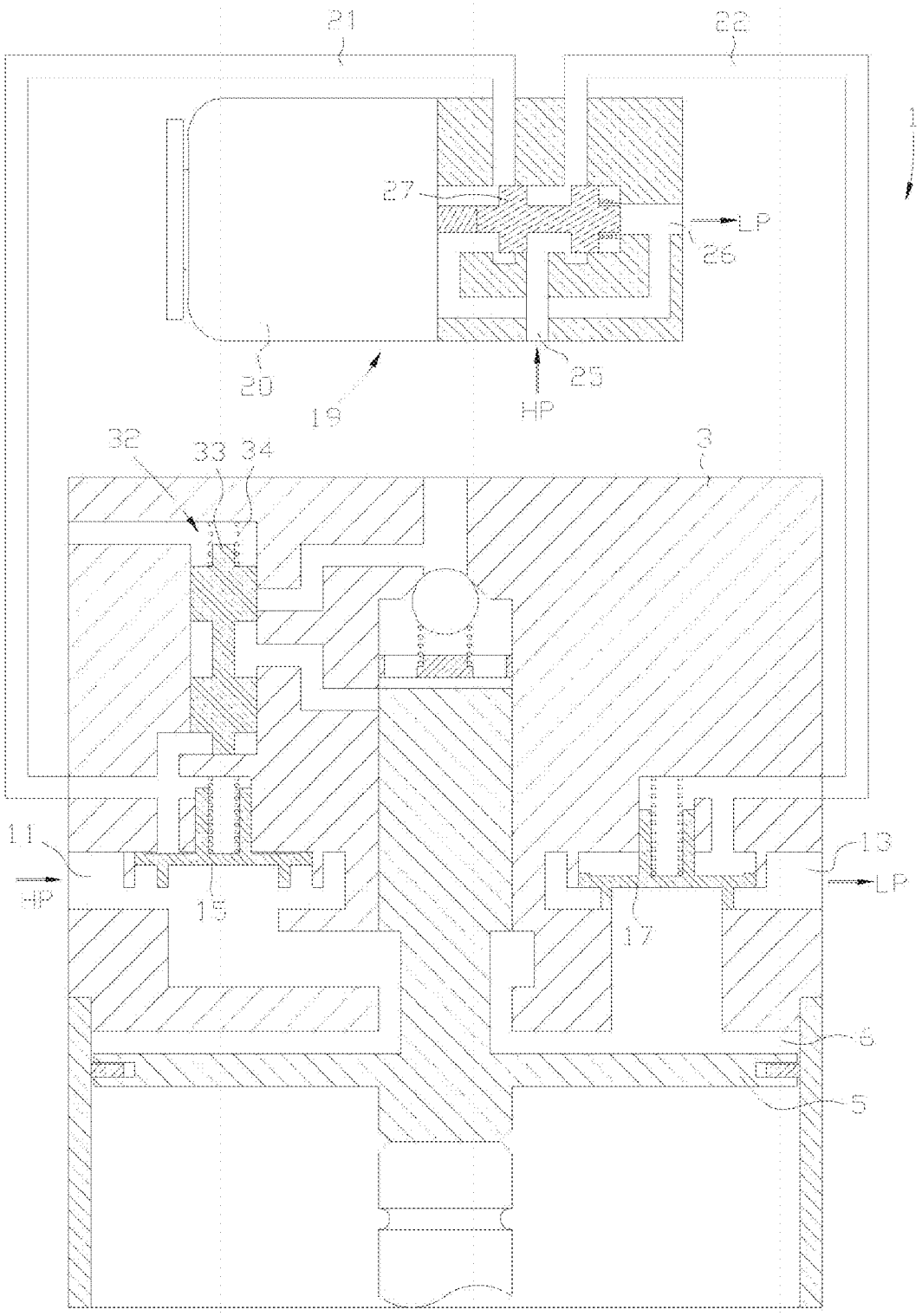
FIG. 4 is a schematic cross sectional view from the side corresponding to FIG. 3, where the pilot valve has been activated but the actuator piston disc still is in its inactive position.

In FIG. 4 a signal has been given by a control unit that the actuator shall perform a displacement of the object/engine valve. The solenoid 20 has been activated and the pilot valve 19 has changed to active state. This lead to a low fluid pressure acting in the first control pressure channel 21 and a high fluid pressure acts in the second control pressure channel 22. The first inlet valve body 15 is opened by the pressure from the pressure fluid source (HP) acting at the pressure fluid inlet 12. The hydraulic valve 32 is closed by its spring 34.

Figure 5:
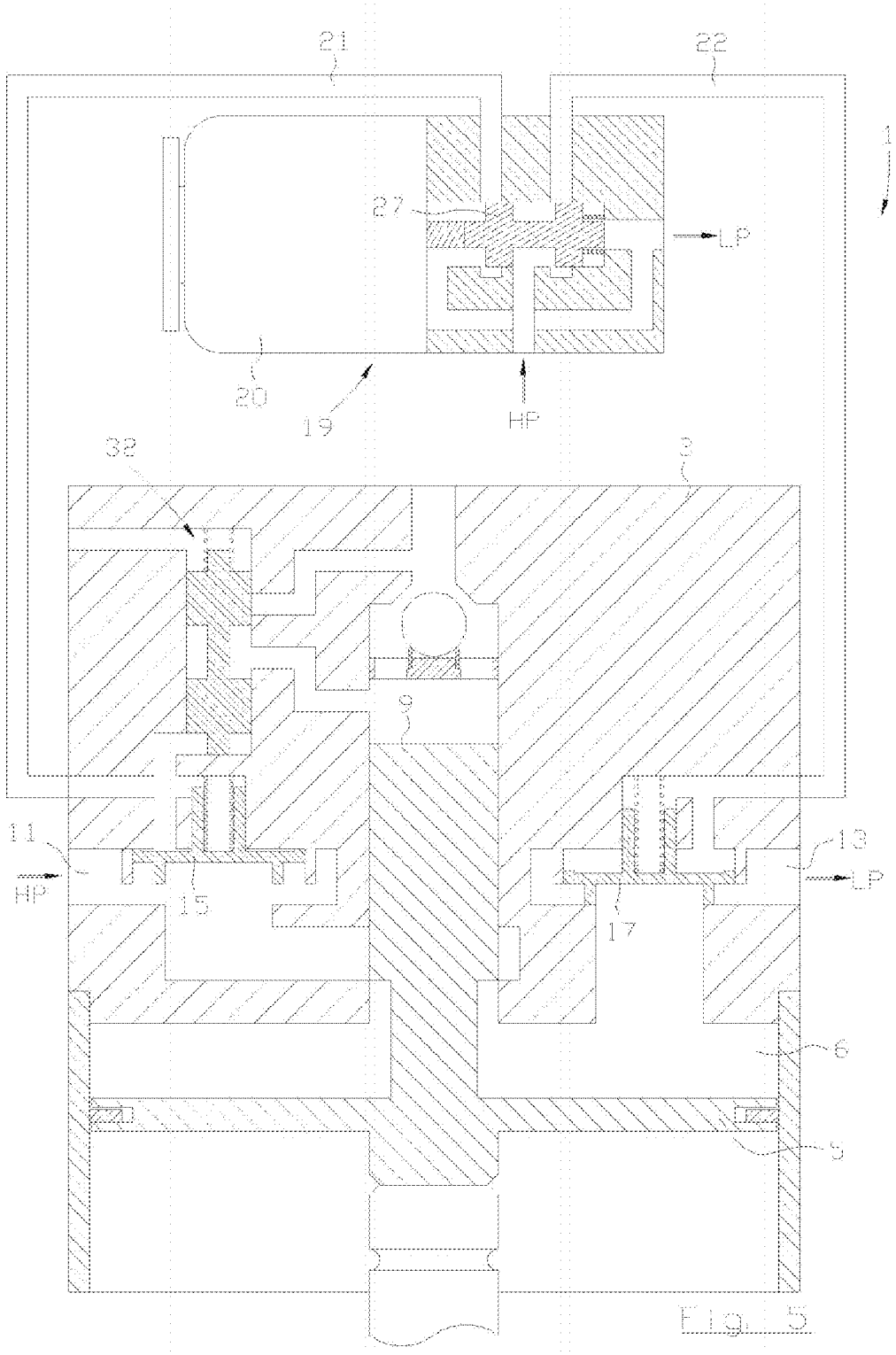
FIG. 5 is a schematic cross sectional view from the side corresponding to FIG. 3, where the actuator piston disc is in movement downward and the pressure pulse is cut by the second inlet valve body.

In FIG. 5 the pressure fluid has begun to flow into the first portion 6 of the cylinder volume via the inlet channel 11 and acts against the upper side of the actuator piston disc 5 and displaces the actuator piston in a downward direction. Liquid is sucked into the locking volume 29 past the non return valve 30. The outlet valve body 17 is kept closed. When the actuator piston disc 5 has been displaced a predetermined distance the second inlet valve 9 cuts off the pressure fluid flow in the inlet channel 11, i.e. prevents a continued inflow of pressure fluid from the pressure fluid source (HP) to the first portion 6 of the cylinder volume, the actuator piston disc further continues its displacement a distance.

Figure 6:
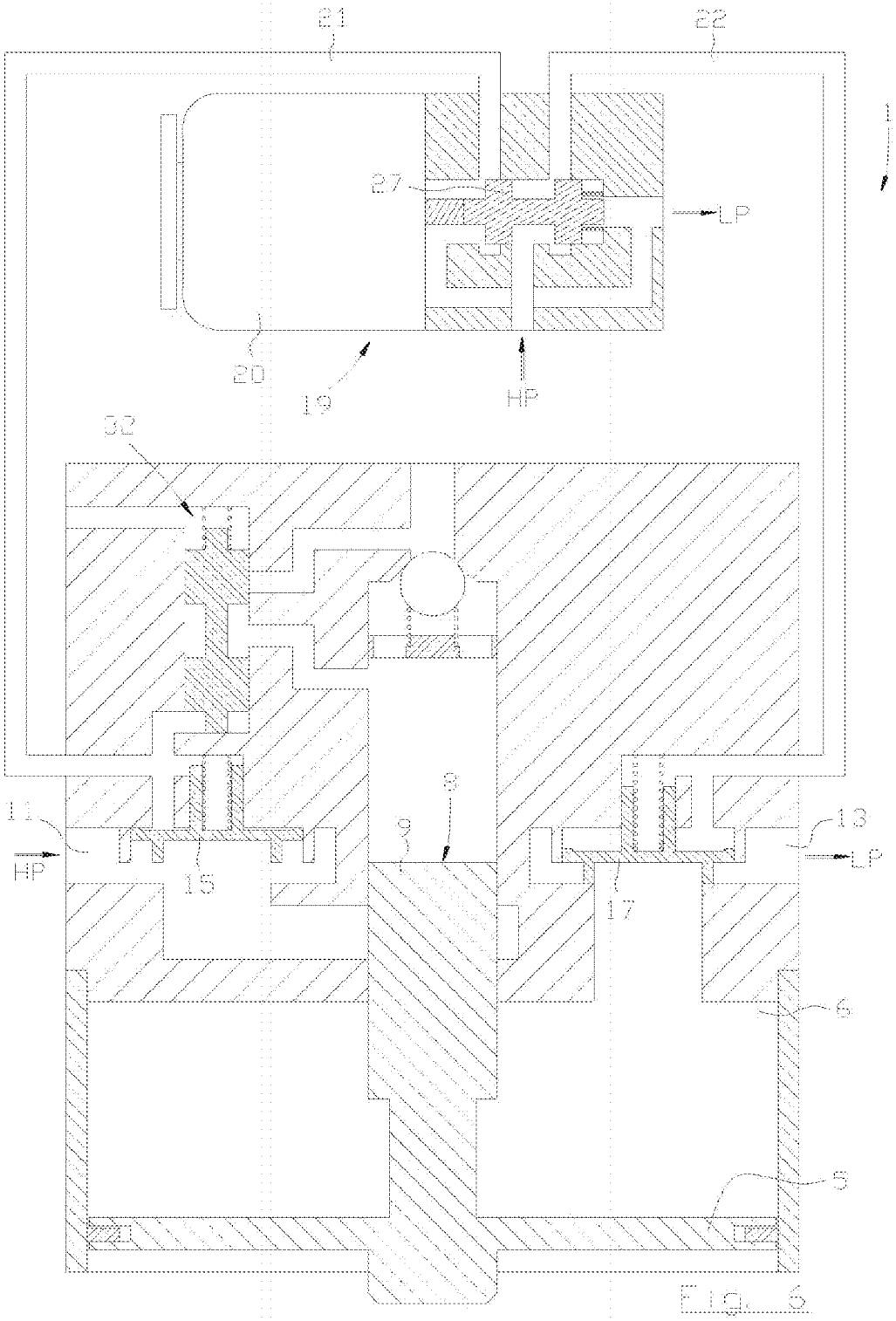
FIG. 6 is a schematic cross sectional view from the side corresponding to FIG. 3, where the actuator piston disc has stopped and is positioned in its lower dead centre.

In FIG. 6 the actuator piston disc 5 has reached its active position/lower dead centre. In this position the actuator piston disc 5 can be locked (kept in place) as a result of the liquid in the locking volume 29 not being allowed to evacuate.

Figure 7:
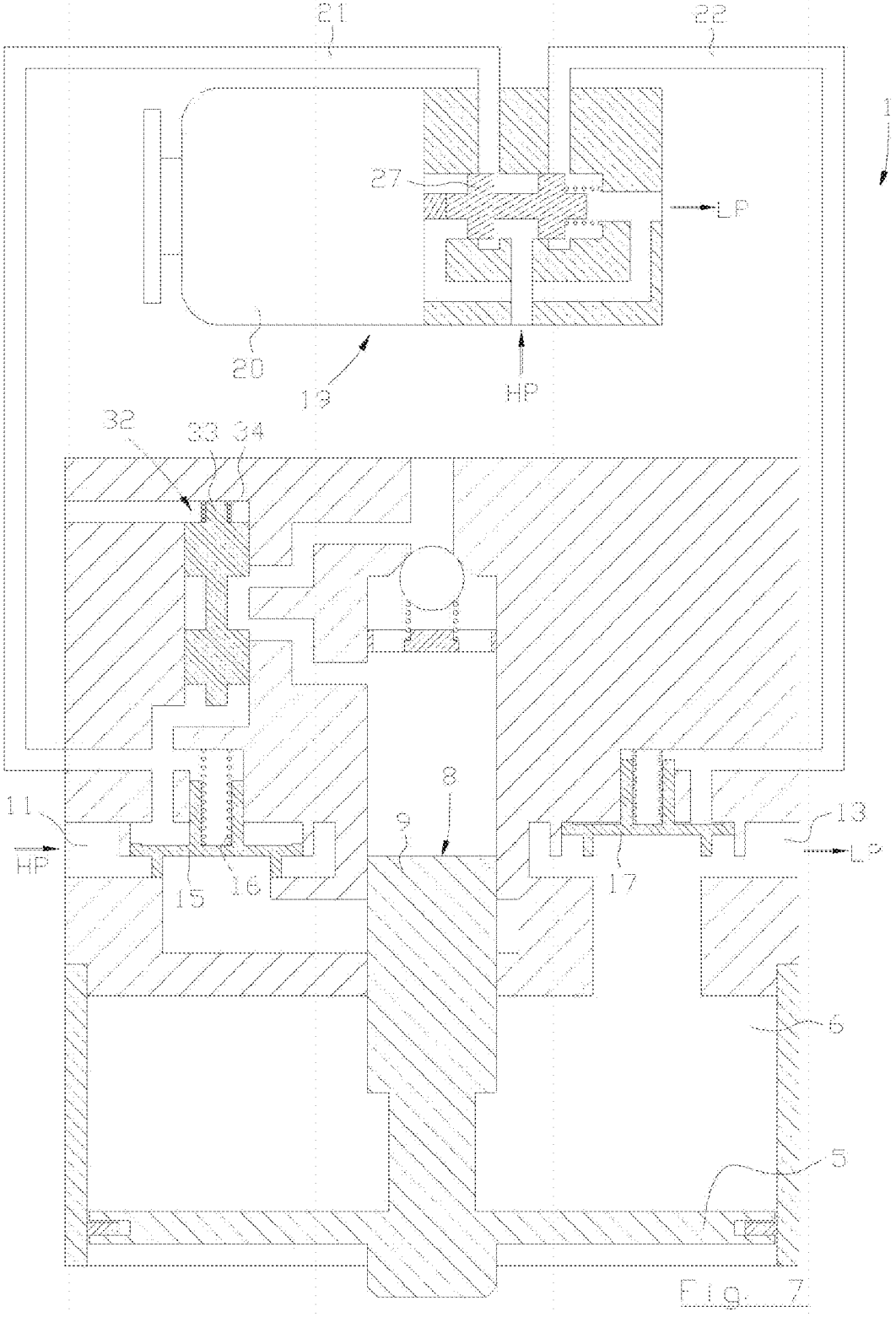
FIG. 7 is a schematic cross sectional view from the side corresponding to FIG. 3, where the pilot valve has been deactivated but the actuator piston disc is still positioned in its lower dead centre.

In FIG. 7 the solenoid 20 has been inactivated, i.e. the pilot valve 19 again reaches its resting state. High fluid pressure acts in the first control pressure channel 21 a low fluid pressure acts in the second control pressure channel 22. The first inlet valve body 15 closes the inlet channel 11, the hydraulic valve 32 is opened to allow evacuation of liquid from the locking volume 29, the outlet valve body 17 is opened by the pressure acting in the first portion 6 of the cylinder volume, and the actuator piston disc 5 can be displace upward by the spring device.

Figure 8:
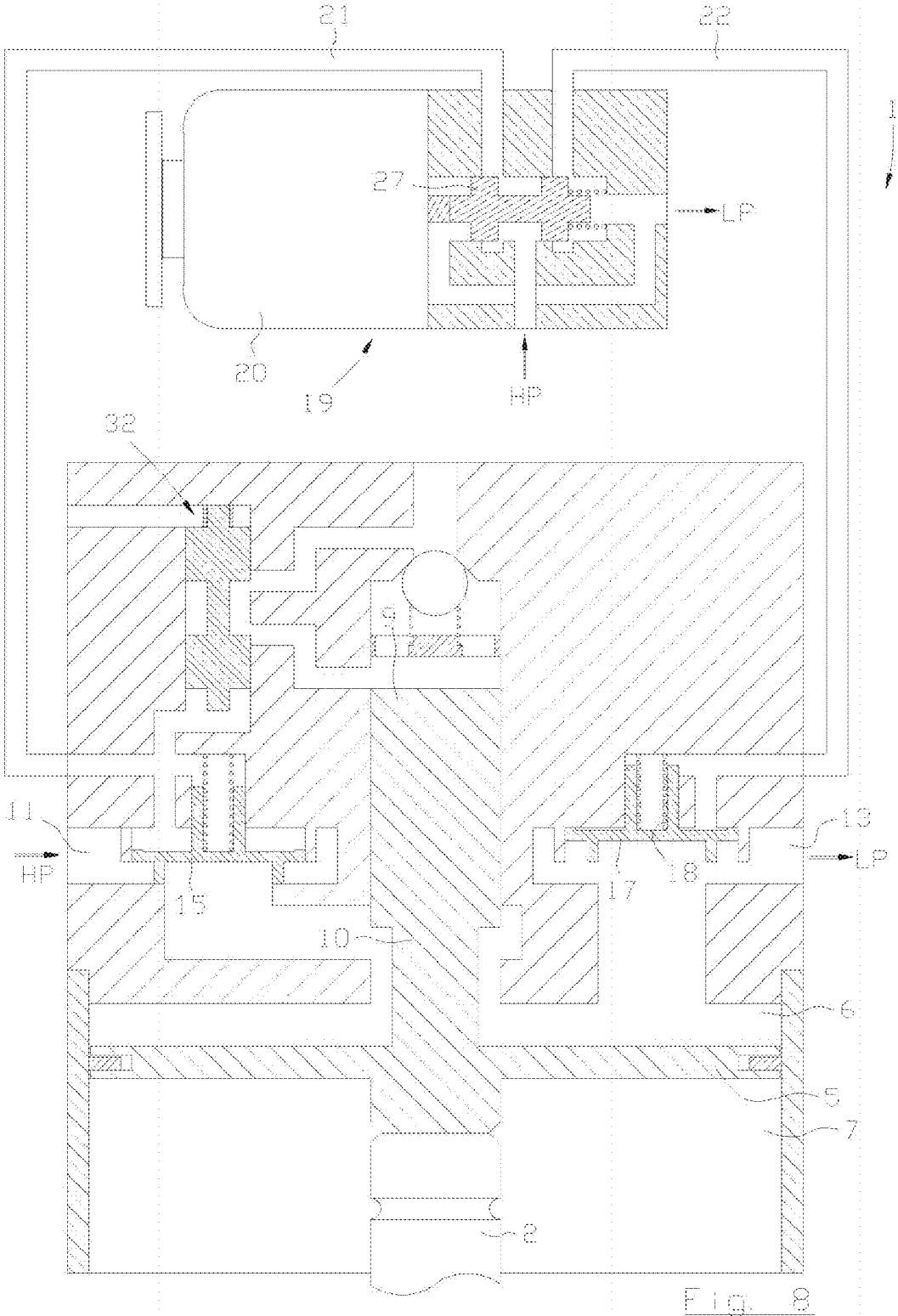
FIG. 8 is a schematic cross sectional view from the side corresponding to FIG. 3, where the actuator piston disc is in movement upward and breaking of the return movement has started.

In FIG. 8 the actuator piston disc 5 is displaced upward after the pressure fluid in the first portion 6 of the cylinder volume is evacuated through the outlet channel 13. Furthermore, breaking of the movement upward of the actuator piston disc 5 starts as a result of the flow area of the sub-channel extending from the locking volume 29 to the hydraulic valve is reduced with continued movement upward of the actuator piston. When the actuator piston disc 5 has reached the inactive position and the pressure in the first portion 6 of the cylinder volume has decreased the outlet valve body 17 is closed by the biasing spring 18. Thereby the actuator is back in the inactive state that is shown in FIG. 3.

Figure 9:
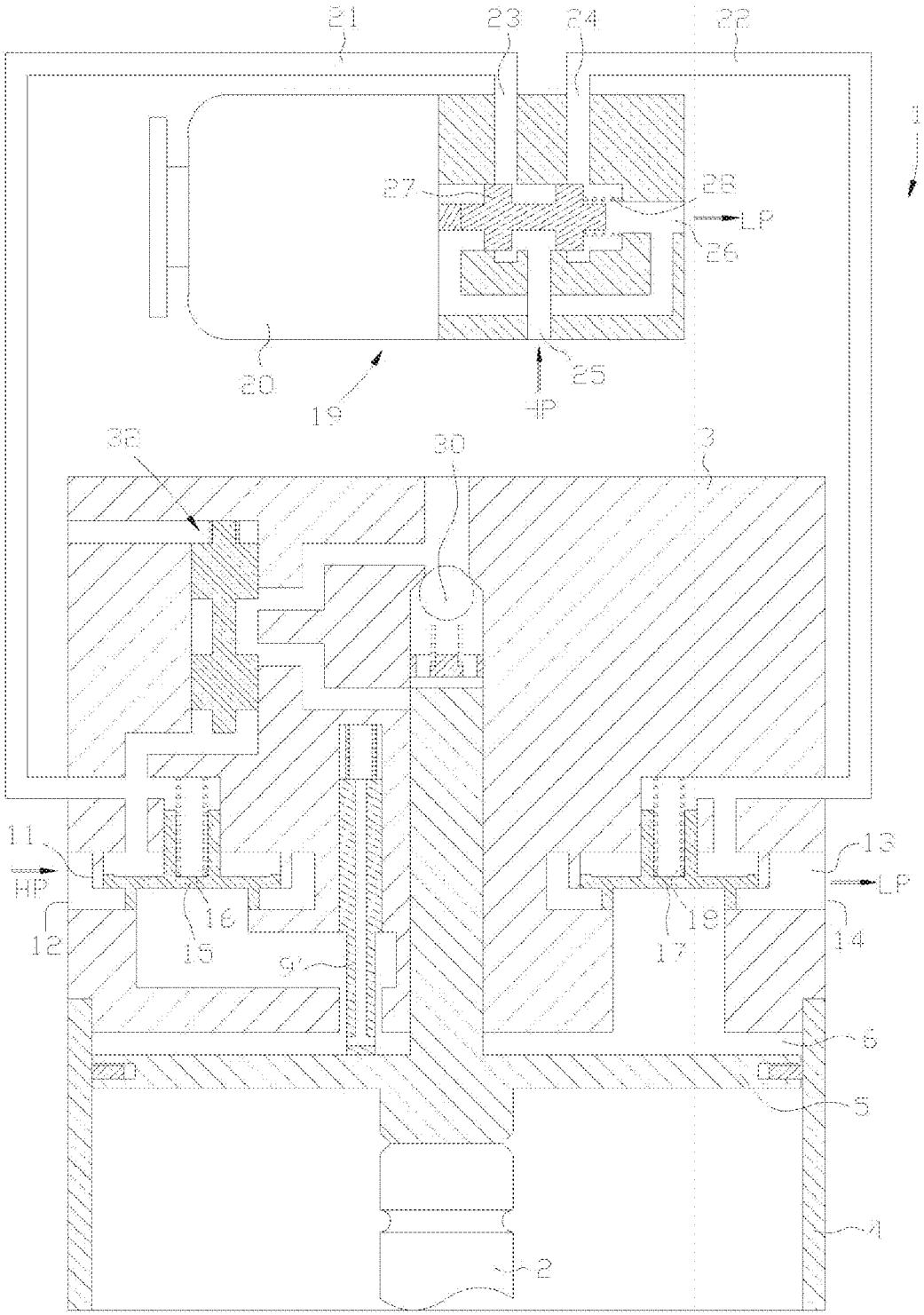
FIG. 9 is a schematic cross sectional view from the side of an actuator according to a third embodiment of the invention, where the actuator is in its inactive state.
Figure 10:
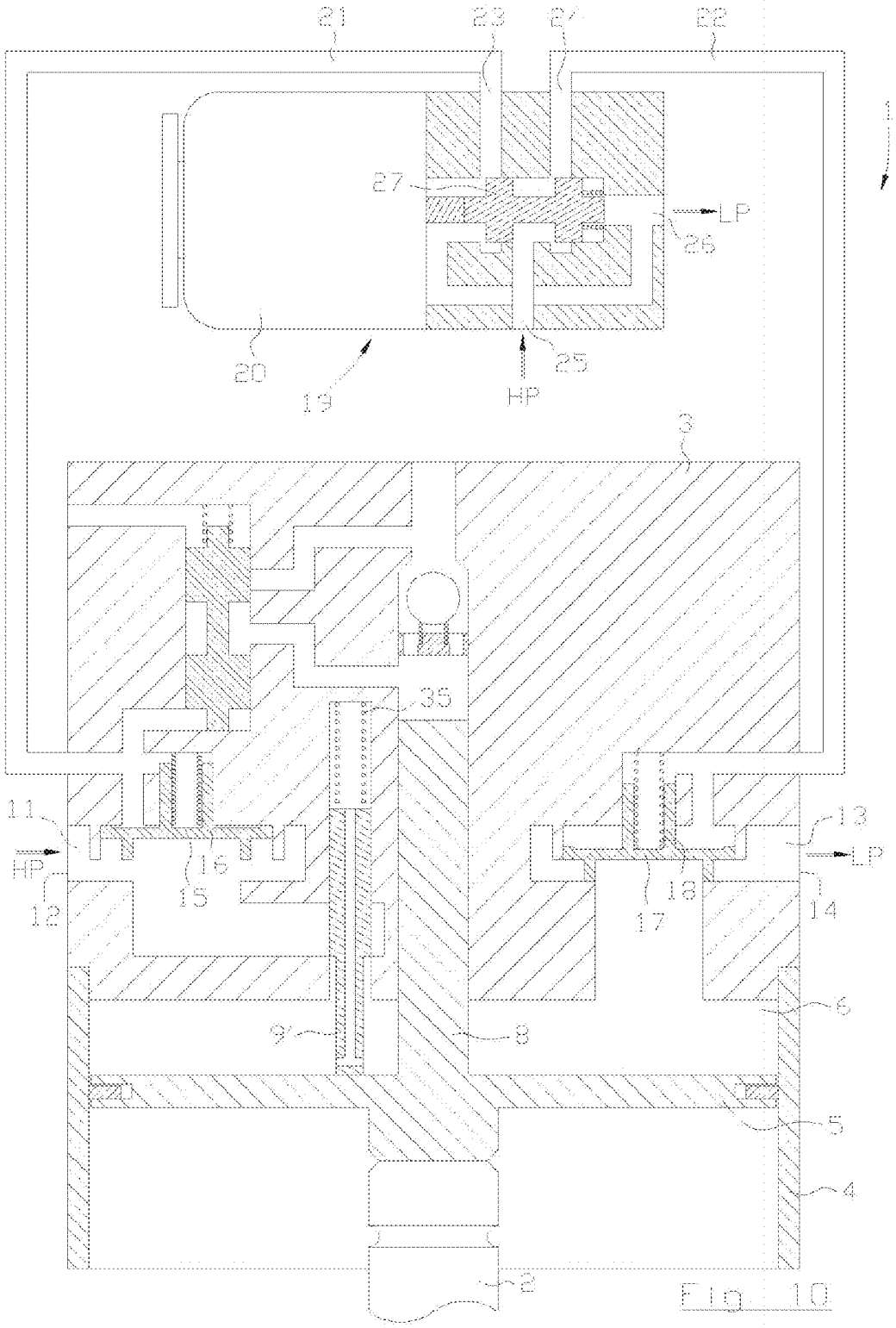
FIG. 10 is a schematic cross sectional view from the side corresponding to FIG. 9, where the actuator piston disc is in movement downward and the pressure pulse is cut off by the second inlet valve body.

Reference is now made to FIGS. 9 and 10, which show a third embodiment of the actuator 1 according to the invention. Only differences relative to the first and the second embodiments will be described.

In this embodiment the actuator comprises a second inlet valve body 9' that is separated from the actuator piston rod 8. The second inlet valve body 9' extends in axial direction and is in contact with the part of the actuator piston disc 5 facing the first portion 6 of the cylinder volume. The second inlet valve body 9' is preferably a slide valve. The second inlet valve body 9' is preferably biased in one the inlet channel 11 closing direction by way of a spring 35. When the actuator piston disc 5 is displaced from its inactive position the second inlet valve body 9' is moved accordingly, and when the actuator piston disc 5 has been displaced a predetermined distance from its resting position the second inlet valve body 9' cuts off the flow in the inlet channel 11. In other words, the actuator piston disc 5 prevents the second inlet valve body 9' from closing the inlet channel 11 until the actuator piston disc 5 has been displaced a predetermined distance from its inactive position.

In an alternative embodiment the second inlet valve body 9' is rigidly attached to and axially displaceable together with the actuator piston disc 5, whereby the spring 35 is not needed.

The second inlet valve body 9' keeps the inlet channel 11 closed as long as the actuator piston disc 5 is at least the predetermined distance from its inactive position.

This third embodiment entail that the diameter of the actuator piston rod 8 can be reduced which results in that to the locking volume 29 becomes smaller and thereby a smaller amount of liquid/oil needs to pass through the non return valve 30 and through the hydraulic valve 32 every displacement of the actuator piston disc 5.

Figure 11:
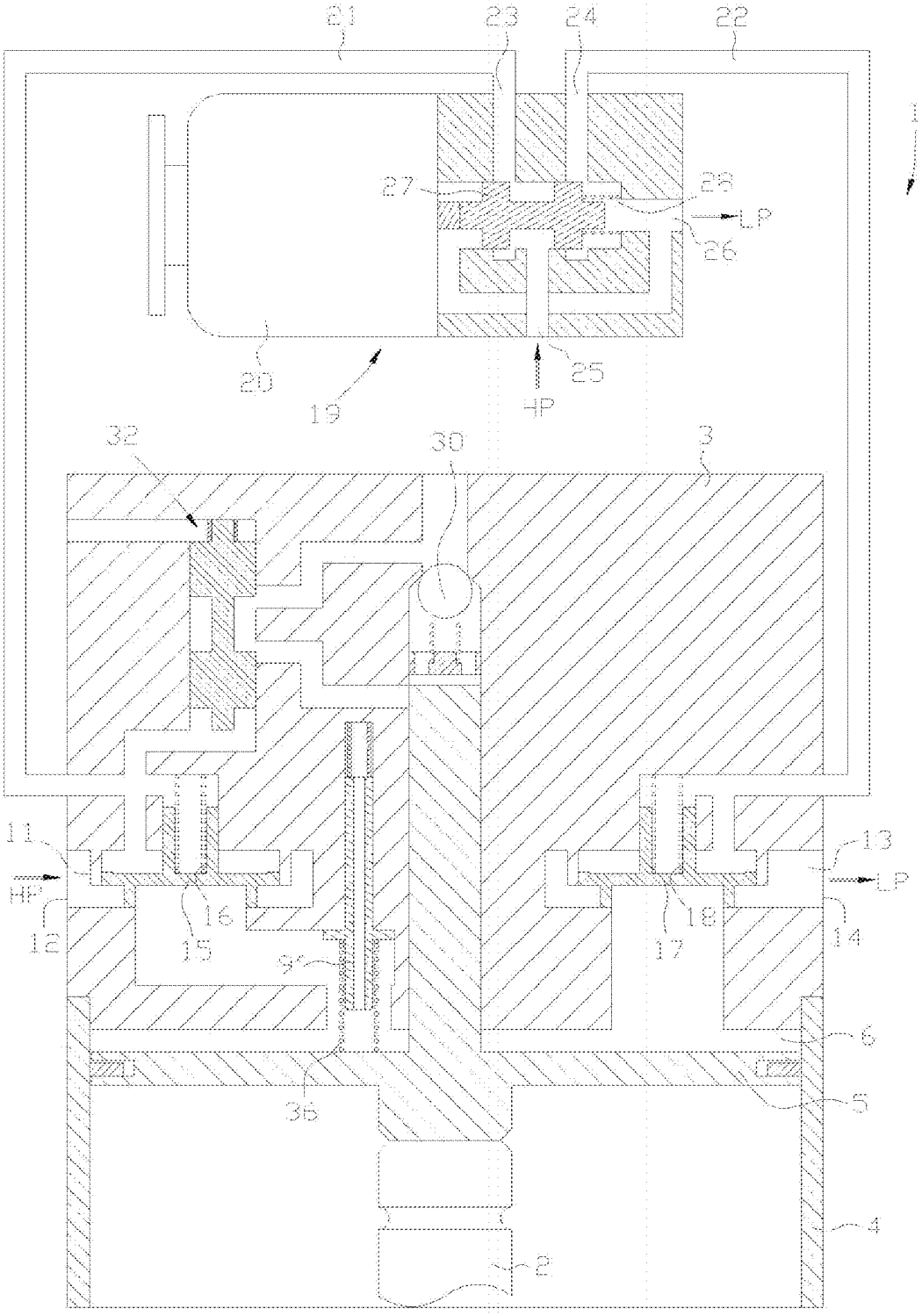
FIG. 11 is a schematic cross sectional view from the side of an actuator according to a fourth embodiment of the invention, where the actuator is in its inactive state.
Figure 12:
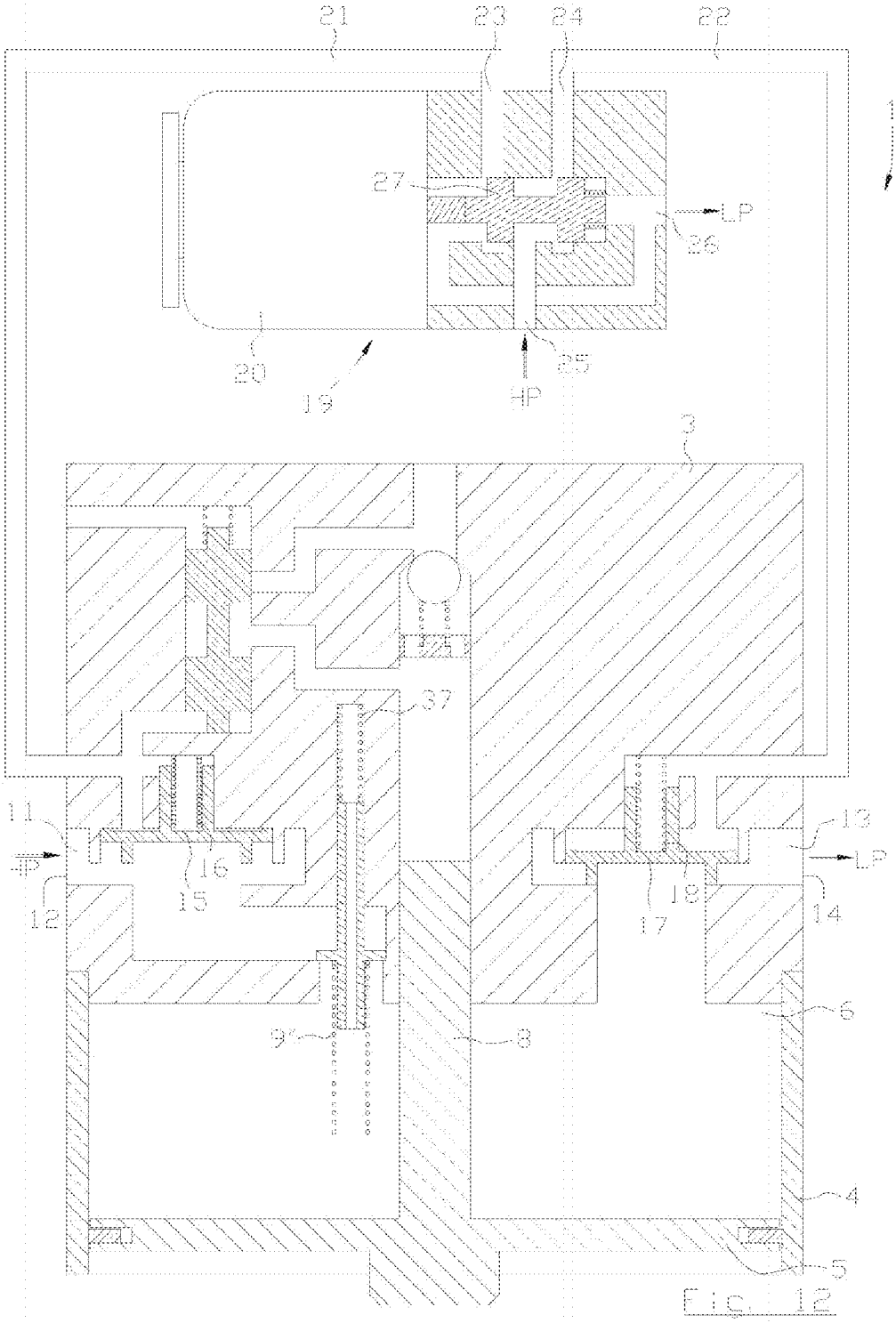
FIG. 12 is a schematic cross sectional view from the side corresponding to FIG. 11, where the actuator piston disc has stopped and is positioned in its lower dead centre.
Figure 13:
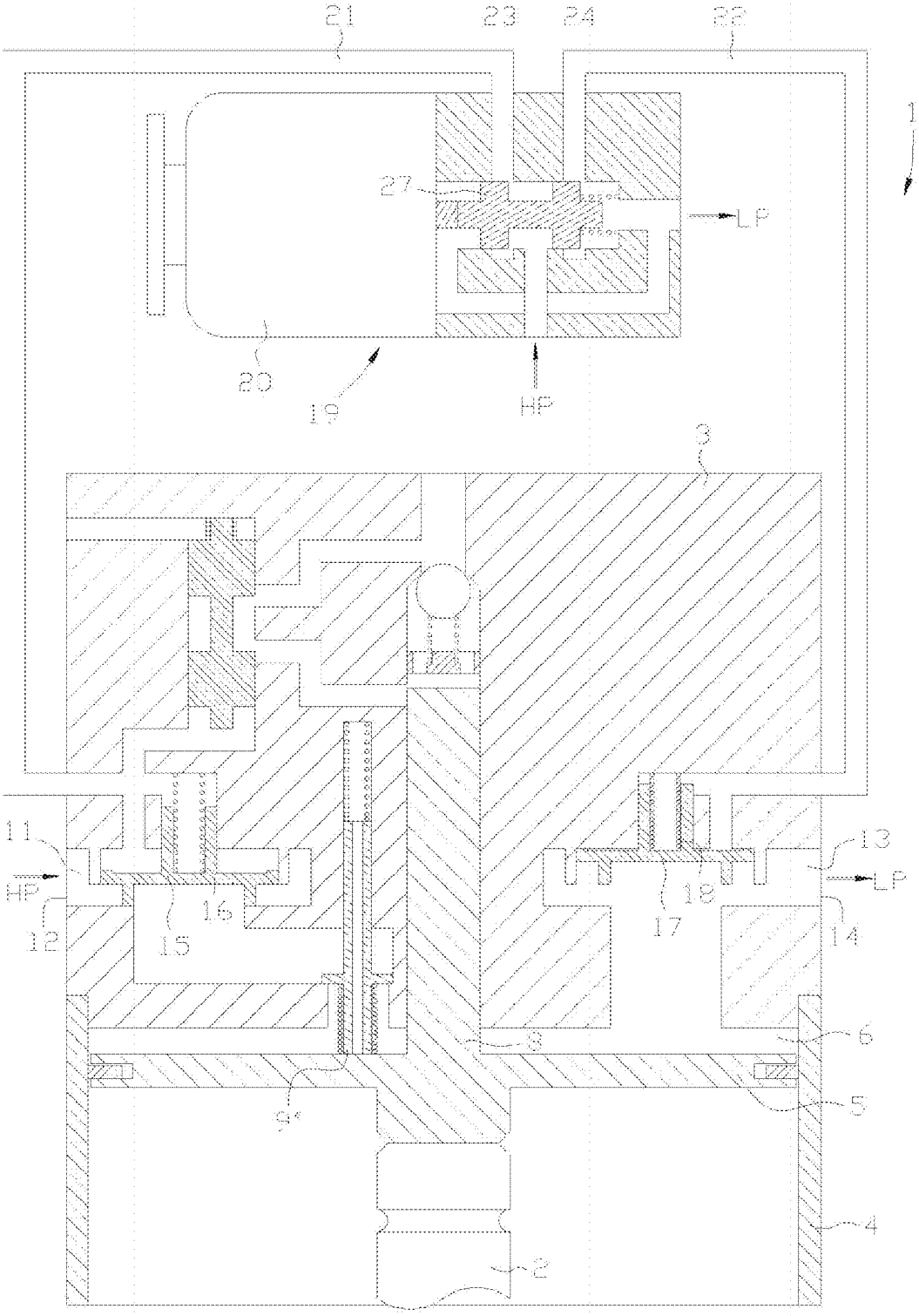
FIG. 13 is a schematic cross sectional view from the side corresponding to FIG. 11, where the actuator piston disc is in movement upward and is about to open the second inlet valve body.

Reference is now made to FIGS. 11-13, which show a fourth embodiment of the actuator 1 according to the invention. Only differences in relation to the other embodiments will be described.

Just like the third embodiment described above the fourth embodiment comprises a second inlet valve body 9" that is separate from the actuator piston rod 8. In this embodiment the second inlet valve body 9" is preferably a seat valve. When the actuator 1 is in its inactive state (see FIG. 11) the second inlet valve body 9" is via a lower spring 36 in contact with the side of the actuator piston disc 5 facing the first portion 6 of the of the cylinder volume. The lower spring 36 is in its upper end connected to the second inlet valve body 9". The lower spring 36 is thereby biasing the second inlet valve body 9" in one the inlet channel 11 opening direction, when the actuator piston disc is in its inactive position. Furthermore, an upper spring 37 also affects the second inlet valve body 9", which upper spring 37 is arranged counteracting said lower spring 36.

In FIG. 11 the actuator is in its inactive position, and the second valve body 9" is held in an upper position. When the actuator 1 is activated the actuator piston disc 5 starts its movement downward and at the same time the lower spring 36 of the second inlet valve body 9" begins to expand in length and the second inlet valve body 9" is held in its upper position. In connection with the actuator piston disc 5 being displaced downward the force that the lower spring 36 acts against the second inlet valve body 9" reduces. After a certain displacement of the actuator piston disc 5, and a simultaneous expansion of the lower spring 36, the force that the upper spring 37 acts with on the second inlet valve body 9" exceeds the force of the lower spring 36, whereby the second inlet valve body 9" is displaced downward in one the inlet channel 11 closing direction. When the actuator piston disc 5 has been displaced a predetermined distance from its inactive position the second inlet valve body 9" closes the inlet channel 11, and preferably the lower spring 36 stops being in contact with the actuator piston disc 5. In FIG. 12 the actuator piston disc 5 is in its lower dead centre.

In FIG. 13 the actuator piston disc 5 is on its way upward and in the inlet channel 11 a pressure fluid quantity at a high pressure is trapped between the first inlet valve body 15 and the second inlet valve body 9", which counteracts displacement upward of the second inlet valve body 9". In FIG. 13 the lower spring 36 has been compressed and the upper side of the actuator piston disc 5 contacts the second inlet valve body 9" and the second inlet valve body 9" is thereafter displaced upward into the upper position by the spring force in the lower spring 36, and the actuator 1 again ends up in its inactive position according to FIG. 11.

Conceivable Modifications of the Invention

The invention is not limited to only the embodiments described above and shown in the drawings, which have illustrating and exemplifying purpose only. This patent application is intended to cover all adjustments and variants of the preferred embodiments described herein, and consequently the present invention is defined by the wording of the appended claims and the equipment can thus be modified in all conceivable ways within the framework of the appended claims.

It shall also be pointed out that all information about/concerning terms such as above, below, upper, lower, etc., shall be understood/read with the equipment oriented in accordance with the figures, with the drawings oriented in such a way that the indexing can be read in a correct way. Thus, similar terms indicate only mutual relationships in the shown embodiments, which relationships can be changed if the equipment according to the invention is provided with another construction/design.

It shall be pointed out that even if it is not explicitly stated that a feature from a specific embodiment can be combined with the features in another embodiment, this shall be considered obvious when possible.

The invention claimed is:

1. Actuator for axial displacement of an object, the actuator comprises:

an actuator piston disc (5), a cylinder volume, wherein the actuator piston disc (5) separates said cylinder volume in a first portion (6) and a second portion (7) and is in axial direction displaceable back and forth in said cylinder volume between an inactive position and an active position, an inlet channel (11) extending between a pressure fluid inlet (12) and the first portion (6) of the cylinder volume, a first inlet valve body (15) and a second inlet valve body (9, 9', 9") arranged in said inlet channel (11), an outlet channel (13) extending between the first portion (6) of the cylinder volume and a pressure fluid outlet (14), an outlet valve body (17) arranged in said outlet channel (13), wherein the actuator comprises an electrically controlled pilot valve (19) configured to communicate a first control pressure to the first inlet valve body (15) via a first control pressure channel (21) and configured to communicate a second control pressure to the outlet valve body (17) via a second control pressure channel (22), wherein the pilot valve (19) is configured to place itself in a resting state, in which the first control pressure channel (21) is in fluid communication with a control fluid inlet (25) of the pilot valve (19) and the second control pressure channel (22) is in fluid communication with a control fluid outlet (26) of the pilot valve (19), and in an active state, in which the first control pressure channel (21) is in fluid communication with the control fluid outlet (26) and the second control pressure channel (22) is in fluid communication with the control fluid inlet (25), respectively, and that the inlet channel (11) is kept closed by the second inlet valve body (9, 9', 9") when the actuator piston disc (5) is located at least a predetermined distance from the actuator piston disc's inactive position.

2. Actuator according to claim 1, wherein the first inlet valve body (15) and the second inlet valve body (9, 9', 9") are arranged in series with each other in said inlet channel (11).

3. Actuator according to claim 2, wherein the second inlet valve body (9, 9', 9") is arranged between the first inlet valve body (15) and the first portion (6) of the cylinder volume.

4. Actuator according to claim 2, wherein the pressure fluid inlet (12) is configured to be connected to a pressure fluid source (HP), and wherein the pressure fluid outlet (14) is configured to be connected to a pressure fluid sink (LP).

5. Actuator according to claim 1, wherein the second inlet valve body (9, 9', 9") is arranged between the first inlet valve body (15) and the first portion (6) of the cylinder volume.

6. Actuator according to claim 5, wherein the pressure fluid inlet (12) is configured to be connected to a pressure fluid source (HP), and wherein the pressure fluid outlet (14) is configured to be connected to a pressure fluid sink (LP).

7. Actuator according to claim 1, wherein the pressure fluid inlet (12) is configured to be connected to a pressure fluid source (HP), and wherein the pressure fluid outlet (14) is configured to be connected to a pressure fluid sink (LP).

8. Actuator according to claim 7, wherein the first inlet valve (15) is configured to be opened by the pressure form the pressure fluid source (HP) when the pilot valve (19) is in the pilot valve's active state.

9. Actuator according to claim 1, wherein the outlet valve (17) is configured to be opened by the pressure from the first portion (6) of the cylinder volume when the pilot valve (19) is in the pilot valve's resting state.

10. Actuator according to claim 1, wherein the control fluid inlet (25) of the pilot valve (19) is configured to be connected to a pressure fluid source (HP), and wherein the control fluid outlet (26) of the pilot valve (19) is configured to be connected to a pressure fluid sink (LP).

11. Actuator according to claim 1, wherein the first inlet valve (15) is constituted by a seat valve, and wherein the outlet valve (17) is constituted by a seat valve.

12. Actuator according to claim 1, wherein the pilot valve (19) comprises a pilot valve body (27), which is displaceable back and forth between a resting position and an active position, wherein the pilot valve body (27) is biased by way of a spring (28) in a direction toward the pilot valve body's resting position.

13. Actuator according to claim 12, wherein the pilot valve body (27) is constituted by a sliding valve.

14. Actuator according to claim 12, wherein the pilot valve (19) comprises a solenoid (20), which is configured to displace the pilot valve body (27) in a direction toward the pilot valve body's active position upon activation of said solenoid (20).

15. Actuator according to claim 1, wherein an actuator piston rod (8) is rigidly connected to and axially extending form the actuator piston disc (5), and together with the actuator piston disc (5) form an actuator piston.

16. Actuator according to claim 15, wherein said second inlet valve (9) constitutes a part of the actuator piston rod (8).

17. Actuator according to claim 1, further comprising a hydraulic circuit, which comprises a locking volume (29), a non return valve (30), and a hydraulic valve (32), wherein the actuator piston rod (8) is arranged to be displaced in axial direction relative to said locking volume (29) in connection with axial displacement of the actuator piston disc (5) in the cylinder volume.

18. Actuator according to claim 17, wherein the hydraulic valve (32) comprises a hydraulic valve body (33) which is displaceable back and forth between a resting position and an active position, wherein the hydraulic valve body (33) is biased by way of a spring (34) in a direction away from its resting position.

19. Actuator according to claim 17, wherein the pilot valve (19) is configured to communicate said first control pressure to the hydraulic valve body (33), wherein the hydraulic valve (32) is open when the pilot valve (19) is in the pilot valve's resting state, and wherein the hydraulic valve (32) is closed when the pilot valve (19) is in the pilot valve's active position.

20. Actuator according to claim 1, wherein the first inlet valve (15) is biased by way of a spring in one the inlet channel (11) closing direction.

* * * * *